US005219619A

United States Patent [19]

Trouve et al.

[11] Patent Number: 5,219,619

[45] Date of Patent: Jun. 15, 1993

[54] COATING PROCESS FOR PAPERS AND CARDBOARDS AND ITS USE FOR OBTAINING PAPER WHICH HAS A GOOD SMOOTHNESS

[75] Inventors: Claude Trouve, Yerres; Michel Richard, L'Isle Adam; Jean Cabestany, Stains, all of France

[73] Assignee: Societe Francaise Hoechst, Puteaux, France

[21] Appl. No.: 840,492

[22] Filed: Feb. 24, 1992

[30] Foreign Application Priority Data

Feb. 25, 1991 [FR] France ..... 91 02210

[51] Int. Cl.[5] ..... B05D 5/00

[52] U.S. Cl. ..... 427/391; 428/511

[58] Field of Search ..... 427/391; 428/511

[56] References Cited

U.S. PATENT DOCUMENTS

| | | | |
|---|---|---|---|
| 3,872,037 | 3/1975 | MacLeod | 427/391 |
| 4,652,471 | 3/1987 | van Rooden et al. | 427/411 |
| 5,139,614 | 8/1992 | dePierne et al. | 427/391 |

*Primary Examiner*—Anthony McFarlane

*Attorney, Agent, or Firm*—Browdy and Neimark

[57] ABSTRACT

Coating process for papers and cardboards, in which cross-linked polymers insoluble in water, containing in molar proportions in the polymerized state:

50 to 99.995% acrylic acid at least 70% of which is in the form of ammonium acrylate, 0.005 to 0.5% bisacrylamidoacetic acid which has about the same neutralization ratio as acrylic acid and, the complement to 100% with acrylamide, are used as coating agent, and use in paper coating.

18 Claims, No Drawings

COATING PROCESS FOR PAPERS AND CARDBOARDS AND ITS USE FOR OBTAINING PAPER WHICH HAS A GOOD SMOOTHNESS

FIELD OF INVENTION

The present invention relates to a coating process for papers and cardboards and its use for obtaining paper which has a good smoothness.

BACKGROUND OF INVENTION

For certain uses, in particular for writing, printing and more particularly photo-engraving, non-rough papers are desired which have a good smoothness optionally combined with a good gloss. Of course, these specific properties must not be acquired to the detriment of other qualities of the paper such as mechanical resistance in the dry or wet state allowing high production rates, good absorption of inks without running, or smudging, or penetration, opacity, whiteness. Giving papers gloss by calendering is well known, combined with a judicious choice of pigments. As for smoothness, it is at present obtained by a difficult compromise between costs and industrial possibilities of the paper maker as a function of the state of the support surface and its formation, the content and nature of the solid matter of the coating, the coating device used, the weight of the deposit and calendering conditions.

As a result, starting with a given support, the paper maker desiring to obtain a paper which has a good smoothness is confronted with a problem which he attempts to solve by a compromise which necessitates numerous costly tests.

SUMMARY OF INVENTION

Now, the Applicant has discovered with astonishment new coating process for papers with a view to giving them a good smoothness which overcomes these inconveniences.

The process according to the invention is characterized by the use, as coating agent, of cross-linked polymers, insoluble in water, containing in molar proportions, in the polymerized state:

50 to 99.995% acrylic acid at least 70% of which is in the form of ammonium acrylate, 0.005 to 0.5% bisacrylamidoacetic acid having about the same neutralization ratio as acrylic acid, and the complement to 100% with acrylamide.

DETAILED DESCRIPTION OF EMBODIMENTS

A more particular subject of the invention is polymers as defined above characterized in that they contain in molar proportions, in the polymerized state:

65 to 95% acrylic acid at least 90% of which is in the ammonium acrylate state, 0.005 to 0.5% bisacrylamidoacetic acid at least 90% of which is in the ammonium bisacrylamidoacetate state, and the complement to 100% with acrylamide.

Among the latter polymers, there can be mentioned more particularly a cross-linked polymer insoluble in water containing in molar proportions:

about 70% acrylic acid neutralized to pH=6.2 with ammonium hydroxide, 0.005 to 0.5% bisacrylamidoacetic acid neutralized to pH=6.2 with ammonium hydroxide, the complement to 100% with acrylamide.

The acrylic acid neutralized to pH=6.2 corresponds to a neutralization ratio greater than 90% and the acrylic acid neutralized to pH=5.2 corresponds to a neutralization ration of about 70%. These neutralization ratios are determined by potentiometric analysis.

Also a subject of the present invention is the compositions intended for paper coating containing, as active ingredient, one of the polymers defined previously.

These compositions are characterized by the fact that they are self-reversible dispersions, whose average particle size is less than 20 μm, constituted on the one hand by an aqueous phase, containing one of the polymers defined previously, dispersed in an oil phase, and on the other hand by at least two emulsifying agents having an overall HLB value greater than 10, at least one of these emulsifying agents possessing an HLB value of less than 5.

The oily phase of the dispersion is constituted, for example, by one or more hydrophobic hydrocarbons such as hexane, cyclohexane, straight or branched $C_8$–$C_{13}$ mineral oil cuts such as paraffin oils or paraffin/-naphthenic oils sold commercially under the name of SHELL white mineral oil, ISOPAR or SOLPAR.

The dispersed aqueous phase represents about 30 to 75% of the total weight of the emulsion and it contains in solution 20 to 40% by weight of a polymer defined previously.

The emulsifying agent with the HLB value of less than 5 is chosen from known emulsifying agents, soluble in oils, such as sorbitan monostearate, monooleate or sesquioleate, and it is contained in the dispersion in proportions of 2 to 8% by weight relative to the total weight of the dispersed aqueous dispersion.

The emulsifying agents present in the dispersion must have an overall HLB value greater than 10, it is therefore necessary to use one or more emulsifying agents having an HLB value greater than 10, so as to compensate for the HLB value of less than 5 of at least one of the emulsifying agents. These emulsifying agents of an HLB value greater than 10 are chosen from known emulsifying agents, soluble in water, such as ethoxylated alkylphenols, sodium dialkylsulphosuccinates, soaps deriving from $C_{10}$–$C_{22}$ fatty acids.

The polymers defined previously and the previously mentioned compositions containing them, which would not be known, can be prepared by similar methods to those described for the preparation of known polymers and the compositions containing them.

The polymers defined previously and the previously mentioned compositions can be prepared in particular by radical-like polymerization in a water-in-oil emulsion. This type of polymerization is extensively described in the literature and it consists of preparing, in the presence of one or more emulsifiers soluble in oils, a water-in-oil emulsion the particles of which have a size of less than 20 μm and containing monomers in solution in the dispersed aqueous phase, then after careful deoxygenation of this emulsion, carrying out the polymerization reaction with an initiator using one or more free radical generators, then finally cooling down the dispersion obtained to ambient temperature after having introduced into it a sufficient quantity of surface-active agent(s) soluble in water, in order to make it self-reversible.

The starting water-in-oil emulsion is prepared using water-in-oil emulsifying agents known for this purpose such as sorbitan monostearate, monooleate, sesquioleate. These emulsifying agents must have an HLB value of less than 5 and they are contained in the emulsion in proportions of 2 to 8% by weight relative to the total weight of the aqueous phase.

The oily phase of the dispersion is constituted for example by one or more hydrophobic hydrocarbons such as hexane, cyclohexane, straight or branched $C_8$–$C_{13}$ mineral oil cuts such as paraffin oils or paraffin/-naphthenic oils sold commercially under the name of SHELL white mineral oil, ISOPAR or SOLPAR.

The dispersed aqueous phase represents about 30 to 75% of the total weight of the emulsion and it contains in solution 20 to 40% by weight of monomers.

The polymerization reaction is initiated by one or more free radical generating agents such as redox pairs, azoic compounds such as azo-bis 4,4' (cyano-4 pentanoic) acid. Advantageously, as a redox pair the pair described in the French Patent No. 2529895 can be used. The polymer-ization temperature depends on the polymerization initiator chosen and can vary within limits ranging from 5° C. to 100° C. for example, but in general the polymerization is carried out at normal pressure at temperatures of 10° to 80° C.

At the end of polymerization, one or more surface-active agents, the HLB value of which is greater than 10, are introduced into the dispersion obtained. They are essentially hydrophilic and hydrosoluble products such as ethyoxylated alkylphenols, sodium dialkylsulphosuccinates, soaps deriving from $C_{10}$–$C_{22}$ fatty acids. Advantageously, ethoxylated nonylphenols with 6 to 12 moles of ethylene oxide are used. In the final dispersion, 2 to 8% by weight relative to the total weight of the dispersion of one or more surface-active agents are incorporated in the final dispersion, having an HLB value greater than 10 so that the overall HLB value of the surface-active agents present in the dispersion is greater than 10.

The process according to the invention is particularly useful for improving the smoothness of paper supports. For this use the process according to the invention is implemented very simply with a standard coating device such as size-press, size-tub, calender sizing, etc., incorporating in the coating colour containing normal pigments and binders as well as optionally other standard additives, the necessary quantity of polymer defined previously, in order to obtain the desired smoothness.

The polymer is used in the form of the previously defined composition. As soon as it is incorporated in the aqueous coating colour containing the normal ingredients such as pigments, binders, at a dose of dry matter comprised between about 50 and 75% by weight, the composition containing the polymer defined previously reverses itself immediately while releasing into the coating colour the polymer swollen with water but insoluble in water. The doses used expressed in grams of dry polymer relative to the weight of dry paper support vary from 0.05 to 0.5%.

The process according to the present invention permits the state of the surface of the paper supports obtained both with a chemical pulp (pulp without wood) and with a mechanical pulp (pulp with wood) to be considerably improved. In addition to improving the state of the surface and decreasing the roughness of the paper, particularly for papers derived from a mechanical pulp, the process according to the invention permits the conditions for implementing coating to be improved, notably:

by suppressing penetration of the paper by the coating colour with as a result the elimination of the bleaching of the backing-roll, by lubricating the blade: coating is carried out much more silently and the comfort of the work place is, because of this, greatly improved, by improving the dynamic water retention on the coated paper: the coating deposited dries much more slowly than in standard processes, which brings about a more even coating, without mask or running, while hardly modifying the viscosity of the coating colours.

It has been noted that the improvement of the smoothness of a paper support was notably a function of the cross-linking rate of the polymer used. For a cross-linking rate of less than 0.005% molar of bisacrylamidoacetic acid practically no improvement in the smoothness is obtained. Also starting with a cross-linking rate greater than 0.5% molar of bisacrylamidoacetic acid, no further improvement in the smoothness is observed.

The following examples illustrate the present invention without however limiting it.

EXAMPLE 1—COMPARISON EXAMPLE

The following are dissolved in 200 g of water:

181 72 g (2.522 mole) of pure acrylic acid 76.82 g (1.081 mole) of pure acrylamide, then the pH of this solution is taken to pH=6.2 by the addition of ammonium hydroxide at 31% by weight. Into this solution, designated hereafter S, are then introduced:

0.36 g of the sodium salt of diethylenetriaminepentaacetic acid, 0.03 g of azo-bis 4,4'-(cyano-4-pentanoic) acid, the quantity of water necessary to obtain a total weight of 709 g. Finally the pH of this solution is adjusted to pH=6.2. The neutralization ratio of the acrylic acid determined by potentiometric analysis is about 92%.

This aqueous solution is then introduced under agitation, at ambient temperature, into a solution of 226.8 g of Shell white mineral oil 2748 and 21.6 g of sorbitan sesquioleate. The emulsion obtained is then homogenized using a turbine then it is carefully deoxygenated for one hour by bubbling nitrogen through it. The polymerization reaction is then initiated under agitation, at 10° C., by the addition of 0.0136 g of cumene hydroperoxide and 0.024 g of thionyl chloride. The temperature of the reaction medium reaches 80° C. in 20 minutes. It is maintained at this temperature for one hour, then cooled down to 50° C. and 10 g of ethoxylated nonylphenol with 8 moles of ethylene oxide, and 10 g of ethoxylated nonylphenol with 10 moles of ethylene oxide are incorporated. The dispersion thus obtained is cooled down to ambient temperature then it is filtered. The characteristics of this dispersion are given in table I.

EXAMPLES 2–6

Example 1 is reproduced, incorporating in the aqueous phase S the following quantities of bisacrylamidoacetic acid, designated ABAA:

Example 2: 0.01 g (0.05 mmole)
Example 3: 0.07 g (0.35 mmole)
Example 4: 0.285 g (1.44 mmole)
Example 5: 0.57 g (2.87 mmoles)
Example 6: 1.14 g (5.75 mmoles)

The physical characteristics of these different dispersions are given in table I.

EXAMPLE 7

The following are dissolved in 200 g of water:
258 78 g (3.59 moles) of pure acrylic acid
12.76 g (0.18 mole) of pure acrylamide
0.052 g (0.26 mmole) of bisacrylamidoacetic acid.
Into this solution there is then introduced:
0.36 g of the sodium salt of diethylenetriaminepentaacetic acid,
0.03 g of azo-bis 4,4'-(cyano-4-pentanoic) acid,
the quantity of water necessary to obtain a total weight of 709 g. Finally the pH of this solution is adjusted to pH=5.2 with ammonium hydroxide at 31% by weight. The neutralization ratio of the acrylic acid determined by potentiometric analysis is about 70%.

This aqueous solution is then subjected to a polymerization reaction in a water-in-oil emulsion according to the process described in Example 1. Then, at the end of polymerization, the dispersion obtained is treated as in Example 1. In this way a dispersion is obtained the characteristics of which are given in table I.

The molar concentrations in ppm of bisacrylamidoacetic acid present in the polymer are mentioned in column A of table I. The Brookfield viscosities determined at 20° C., with a Brookfield RVT apparatus, at a speed of 20, of the various dispersions at 1% by weight in water are indicated in column B. The Brookfield viscosities determined at 20° C., with a Brookfield RVT apparatus at a speed of 20, of the various dispersions at 1% by weight in water containing 0.1% by weight of sodium chloride are indicated in column C. All the viscosities are expressed in Pa.s. All the dispersions have a content of 30% by weight of active ingredients and they possess an excellent sedimentation stability: no deposit or salting-out after one month of storage at 20° C.

TABLE 1

| EXAMPLES | A | B | C |
|---|---|---|---|
| 1 | 0 | 8.85 | 7.6 |
| 2 | 14 | 11.5 | 8.7 |
| 3 | 100 | 32 | 14.8 |
| 4 | 400 | 40 | 13.5 |
| 5 | 800 | 72 | 4.1 |
| 6 | 1600 58 | 0.71 | |

EXAMPLES 8-24 and Comparison Examples C1-C7

In these examples, a paper support obtained either with a chemical pulp B1, or with a mechanical pulp B2, is treated with a coating colour of which the composition in dry matter expressed in g is given in table II, on a Heliocoater type MK IV from the Charlestown Engineering Company. The weight of the deposit, as well as the pH and the viscosity of the coating colour are also set out in table II. The coated paper is then subjected to drying by hot air at 200° C. for 20 seconds, then its smoothness is determined with a BEKK measuring apparatus according to the French standard NF Q 03-012 of February, 1974, and the results are expressed in seconds. The longer the time the better the smoothness is.

In table II, the weights are expressed in grams and the viscosities, determined on a Brookfield RVT apparatus at 20° C., at the speed and with the spindle recommended for the value indicated, are expressed in mPa.s. The rheology modifiers of the coating colour are either the products described in the examples, or carboxymethylcellulose, designated CMC, and marketed by the Applicant under the reference TYLOSE® VCLL. The binders L1 and L2 are binders commonly used in paper coating; binder L1 is a latex SBR marketed by the DOW FRANCE company under the reference DL 675 SBR and binder L2 is an acrylic latex marketed by the Applicant under the reference MOWILIT DM 595. The pH of the coating colour is adjusted to the value indicated with 10% soda. The angle of the coating apparatus blade is expressed in degrees. In Examples 8, 9 and Comparison Example C1, the smoothness is determined visually by a visual examination of the coated paper; for these three examples, Example 9 gives an excellent smoothness, Example 8 gives a slightly inferior smoothness to that of Example 9, and Example C1 gives a poor smoothness.

Examples 8-10 and Comparison Examples C1, C2 show the use of the process according to the invention. With an identical weight of deposit on an identical paper support, the process according to the invention permits the smoothness to be significantly improved (58 against 46) which represents a deposit saving of 0.75 g/m$^2$ for the same smoothness.

Examples 11-14 and Comparison Examples C3, C4 and C5 confirm the use of the process according to the invention. With the same dry extract, the viscosity of the baths using the process according to the invention is higher, but that does not constitute an obstacle to their use on supports; the deposits obtained are homogeneous and of the same class. Furthermore, at a more or less identical viscosity (680+−20 mPa.s), with a different dry extract, 62.2% against 52.8%, the smoothness is better when the process of the invention is used.

Examples 15-17 and Comparison Example C6 also confirm the use of the process according to the invention.

Examples 18 21 and Comparison Example C7 permit the use of the process according to the invention to be revealed: relative to a carboxymethylcellulose, the process according to the invention permits a smoothness greater than about 40% to be obtained.

In Examples 22-24, for comparable deposits, a slight drop in smoothness due to an increase in the cross-linking rate of the polymer is observed.

TABLE II

| | (1st part) | | | | | (2nd part) | | | | | | | | | | |
|---|---|---|---|---|---|---|---|---|---|---|---|---|---|---|---|---|
| | C1 | 8 | 9 | C2 | 10 | C3 | C4 | C5 | 11 | 12 | 13 | 14 | C6 | 15 | 16 | 17 |
| Formulation of the coating mass | | | | | | | | | | | | | | | | |
| Pigment | | | | | | | | | | | | | | | | |
| calcium carbonate | 100 | 100 | 100 | | | | | | | | | | 100 | 100 | 100 | 100 |
| kaolin | | | | 80 | 80 | 80 | 80 | 80 | 80 | 80 | 80 | 80 | | | | |
| talc | | | | 20 | 20 | 20 | 20 | 20 | 20 | 20 | 20 | 20 | | | | |
| Binder | | | | | | | | | | | | | | | | |
| nature | L1 | L1 | L1 | L2 | L2 | L2 | L2 | L2 | L2 | L2 | L2 | L2 | L1 | L1 | L1 | L1 |
| weight | 12 | 12 | 12 | 5 | 5 | 5 | 5 | 5 | 5 | 5 | 5 | 5 | 12 | 12 | 12 | 12 |
| Rheology modifier | | | | | | | | | | | | | | | | |

TABLE II-continued

| | | | | | | | | | | | | | | | | |
|---|---|---|---|---|---|---|---|---|---|---|---|---|---|---|---|---|
| nature | | Ex 7 | Ex 7 | | Ex 7 | | | | Ex 7 | Ex 7 | Ex 7 | Ex 7 | CMC | Ex 4 | Ex 4 | Ex 4 |
| weight | 0 | 0.25 | 0.5 | 0 | 0.4 | 0 | 0 | 0 | 0.4 | 0.4 | 0.4 | 0.4 | 1 | 0.4 | 0.55 | 0.7 |
| Dry extract in % by weight | 69.4 | 69.7 | 70.0 | 58.5 | 58.5 | 62.2 | 60.8 | 58.2 | 58.5 | 57.2 | 56.2 | 52.8 | 61.6 | 61.8 | 61.2 | 61.3 |
| viscosity mPa.s | 1560 | 1200 | 2280 | 400 | 2400 | 660 | 380 | 190 | 2850 | 1950 | 1400 | 700 | 455 | 210 | 600 | 1800 |
| Ph | 9 | 9 | 9 | 9 | 9 | 9 | 9 | 9 | 9 | 9 | 9 | 9 | 9 | 9 | 9 | 9 |
| Support | | | | | | | | | | | | | | | | |
| nature | B1 | B1 | B1 | B2 | B2 | B2 | B2 | B2 | B2 | B2 | B2 | B2 | B2 | B2 | B2 | B2 |
| basis weight g/m$^2$ | 80 | 80 | 80 | 39 | 39 | 39 | 39 | 39 | 39 | 39 | 39 | 39 | 39 | 39 | 39 | 39 |
| Operating conditions | | | | | | | | | | | | | | | | |
| speed m/min | 600 | 600 | 600 | 600 | 600 | 600 | 600 | 600 | 600 | 600 | 600 | 600 | 600 | 600 | 600 | 600 |
| angle of the blade in degrees | 62 | 62 | 62 | 62 | 62 | 62 | 62 | 62 | 62 | 62 | 62 | 62 | 59 | 59 | 59 | 59 |
| thickness of blade mm | 0.245 | 0.245 | 0.245 | 0.254 | 0.254 | 0.254 | 0.254 | 0.254 | 0.254 | 0.254 | 0.254 | 0.254 | 0.508 | 0.508 | 0.508 | 0.508 |
| Results | | | | | | | | | | | | | | | | |
| deposit g/m$^2$ | 10 | 10 | 10 | 7.5 | 7.5 | 9 | 9 | 9 | 9 | 9 | 9 | 9 | 7.66 | 8.06 | 8.04 | 8.07 |
| smoothness | | | | 46 | 58 | 45 | 49 | 55 | 68 | 60 | 56 | 58 | 29 | 33 | 38 | 40 |

| | (3rd part) | | | | | | | |
|---|---|---|---|---|---|---|---|---|
| | C7 | 18 | 19 | 20 | 21 | 22 | 23 | 24 |
| Formulation of the coating mass | | | | | | | | |
| Pigment | | | | | | | | |
| calcium carbonate | 100 | 100 | 100 | 100 | 100 | 100 | 100 | 100 |
| kaolin | | | | | | | | |
| talc | | | | | | | | |
| Binder | | | | | | | | |
| nature | L1 | L1 | L1 | L1 | L1 | L1 | L1 | L1 |
| weight | 12 | 12 | 12 | 12 | 12 | 12 | 12 | 12 |
| Rheology modifier | | | | | | | | |
| nature | CMC | Ex 1 | Ex 2 | Ex 3 | Ex 4 | Ex 4 | Ex 5 | Ex 6 |
| weight | 1 | 0.4 | 0.4 | 0.4 | 0.4 | 0.6 | 0.6 | 0.6 |
| Dry extract in % by weight | 61.5 | 61.6 | 61.7 | 61.3 | 61.4 | 61.0 | 61.0 | 61.0 |
| viscosity mPa.s | 475 | 870 | 1580 | 770 | 210 | 750 | 345 | 210 |
| Ph | 9 | 9 | 9 | 9 | 9 | 9 | 9 | 9 |
| Support | | | | | | | | |
| nature | B2 | B2 | B2 | B2 | B2 | B2 | B2 | B2 |
| basis weight g/m$^2$ | 39 | 39 | 39 | 39 | 39 | 39 | 39 | 39 |
| Operating conditions | | | | | | | | |
| speed m/min | 600 | 600 | 600 | 600 | 600 | 600 | 600 | 600 |
| angle of the blade in degrees | 59 | 59 | 59 | 59 | 59 | 59 | 59 | 59 |
| thickness of blade mm | 0.508 | 0.508 | 0.508 | 0.508 | 0.508 | 0.508 | 0.508 | 0.508 |
| Results | | | | | | | | |
| deposit g/m$^2$ | 8.3 | 8.2 | 8.5 | 8.4 | 7.5 | 8.1 | 8.1 | 8.0 |
| smoothness | 27 | 39 | 38 | 35 | 37 | 44.9 | 43.1 | 38.1 |

We claim:

1. Coating process for papers and cardboards, comprising coating the paper or cardboard with a coating composition comprising a cross-linked polymer insoluble in water, containing in moral proportions in the polymerized state:

50 to 99.995% acrylic acid at least 70% of which is in the form of ammonium acrylate, 0.005 to 0.5% bisacrylamidoacetic acid having about the same neutralization ratio as acrylic acid and, the remainder to 100% being acrylamide.

2. Process according to claim 1, characterized in that the polymer contains in molar proportions:

65 to 95% acrylic acid at least 90% of which is in the state of ammonium acrylate, 0.005 to 0.5% bisacrylamidoacetic acid at least 90% of which is in the state of ammonium bisacrylamidoacetate and, the remainder to 100% being acrylamide.

3. Process according to claim 1, characterized in that the polymer contains in molar proportions, in the polymerized state:

about 70% acrylic acid neutralized to pH=6.2 with ammonium hydroxide, 0.005 to 0.5% bisacrylamidoacetic acid neutralized to pH=6.2 with ammonium hydroxide and, the remainder to 100% being acrylamide.

4. Process according to claim 1, characterized in that the polymer used is contained in a self-reversible water-in-oil dispersion the average particle size of which is less than 20 μm.

5. Process according to claim 2, wherein the polymer contains, in molar proportions:

about 70% acrylic acid neutralized to pH=6.2 with ammonium hydroxide, 0.005 to 0.5% bisacrylamidoacetic acid neutralized to pH=6.2 with ammonium hydroxide and, the remainder to 100% being acrylamide.

6. Process according to claim 2, wherein the polymer used is contained in a self-reversible water-in-oil dispersion the average particle size of which is less than 20 μm.

7. Process according to claim 3, wherein the polymer used is contained in a self-reversible water-in-oil dispersion the average particle size of which is less than 20 μm.

8. Process according to claim 7, wherein the polymer used is contained in a self-reversible water-in-oil dispersion the average particle size of which is less than 20 μm.

9. Process according to claim 1 wherein said composition comprises 0.05 to 100% by weight of said polymer on a dry basis.

10. Process according to claim 2 wherein said composition comprises 0.05 to 100% by weight of said polymer on a dry basis.

11. Process according to claim 3 wherein said composition comprises 0.05 to 100% by weight of said polymer on a dry basis.

12. Process according to claim 4 wherein said composition comprises 0.05 to 100% by weight of said polymer on a dry basis.

13. Process according to claim 10 wherein said composition comprises 0.05 to 100% by weight of said polymer on a dry basis.

14. Process according to claim 11 wherein said composition further comprises coloring additives.

15. Process according to claim 15 wherein said composition further comprises coloring additives.

16. Process according to claim 4 wherein said dispersion comprises an aqueous phase containing said polymer, dispersed in an oil phase, and at least two emulsifying agents having an overall HLB value greater than 10, at least one of said emulsifying agents having an HLB value of less than 5, said dispersed aqueous phase comprising about 30–75% of the total weight of emulsion and containing in solution 20–40% by weight of said polymer.

17. Process according to claim 14, wherein said dispersion comprises about 50–75% by weight, on a dry basis, of said coating composition; and wherein said coating is applied at a rate, expressed in units of polymer on a dry basis relative to the weight of the dry paper, of from 0.05 to 0.5%.

18. Process according to claim 4, wherein said dispersion comprises about 50–75% by weight, on a dry basis, of said coating composition; and wherein said coating is applied at a rate, expressed in units of polymer on a dry basis relative to the weight of the dry paper, of from 0.05 to 0.5%.

* * * * *